US005427290A

United States Patent [19]

Thatcher

[11] Patent Number: 5,427,290

[45] Date of Patent: Jun. 27, 1995

[54] WATER POUCH BACKPACK

[75] Inventor: G. Bryce Thatcher, Rexburg, Id.

[73] Assignee: Ultimate Direction, Inc., Rexburg, Id.

[21] Appl. No.: 179,135

[22] Filed: Jan. 10, 1994

[51] Int. Cl.[6] ..... A45F 5/00

[52] U.S. Cl. ..... 224/148; 224/209; 224/215

[58] Field of Search ..... 224/148, 163, 191, 202, 224/209–212, 214–216, 250, 257–259, 261–264; 222/175, 464, 525, 529; 220/408; 383/901

[56] References Cited

U.S. PATENT DOCUMENTS

| | | | |
|---|---|---|---|
| 2,041,515 | 5/1936 | Richards | 383/901 |
| 3,024,875 | 3/1962 | Stuttz | 188/88 |
| 4,096,978 | 6/1978 | Noice | 224/8 R |
| 4,815,893 | 3/1989 | Feder | 405/186 |
| 5,060,833 | 10/1991 | Edison et al. | 224/148 |
| 5,114,059 | 5/1992 | Thatcher | 224/209 |

*Primary Examiner*—Henry J. Recla
*Assistant Examiner*—David J. Walczak
*Attorney, Agent, or Firm*—Hopkins, Roden, Crockett, Hansen & Hoopes

[57] ABSTRACT

A sportsman's or athlete's water pouch backpack having a body portion connected to the person by a pair of padded shoulder straps and a quick-release, buckled hip belt. A removable bladder assembly is contained within the pack and has a bladder having a fill connection, a tube and mouthpiece valve, a handle and an internal baffle that maintains a proper bladder shape and prevents sloshing when the bladder is filled with liquid.

11 Claims, 3 Drawing Sheets

WATER POUCH BACKPACK

FIELD OF THE INVENTION

The present invention relates to a sportsman's water pouch backpack having padded and adjustable shoulder straps and a padded and adjustable hip belt.

BACKGROUND OF THE INVENTION

For sportsman such as bicyclists, runners, hikers, and the like, it is important that they restore their body water content to avoid heat exhaustion and dehydration.

U.S. Pat. No. 5,060,833, discloses a shoulder pack that straps between a biker's shoulders and by gravity feed, provides water to the biker through a tube and check valve actuated by the biker's mouth. It also can contain an oxygen bottle for breathing. The pack does not have a stabilizing hip belt, nor a bladder baffle to control the shape of the water container.

It is the purpose of this invention to provide a pack that is supported in the low back region, is stable during body active action, and has a low profile removable container or bladder that maintains a proper flat shape.

SUMMARY OF THE INVENTION

Generally stated the lower back mounted sportsman's water pouch backpack consists of:

- a body having a chamber and an access to the chamber;
- an adjustable hip belt and buckle attaching to a lower portion of the body;
- a pair of adjustable shoulder straps connecting from an upper portion of the body to a lower portion of the body
- a bladder assembly inserted within the body further comprising a flexible bladder having a baffle within the bladder thereby preventing a ballooning of the bladder when filled with a fluid;
- a tube having a first end in communication with an inside of the bladder and having a valve on a second end; and
- a filling connection and filler cap on the bladder in communication with the inside of the bladder.

DETAILED DESCRIPTION OF THE PREFERRED EMBODIMENTS

Figure 1:
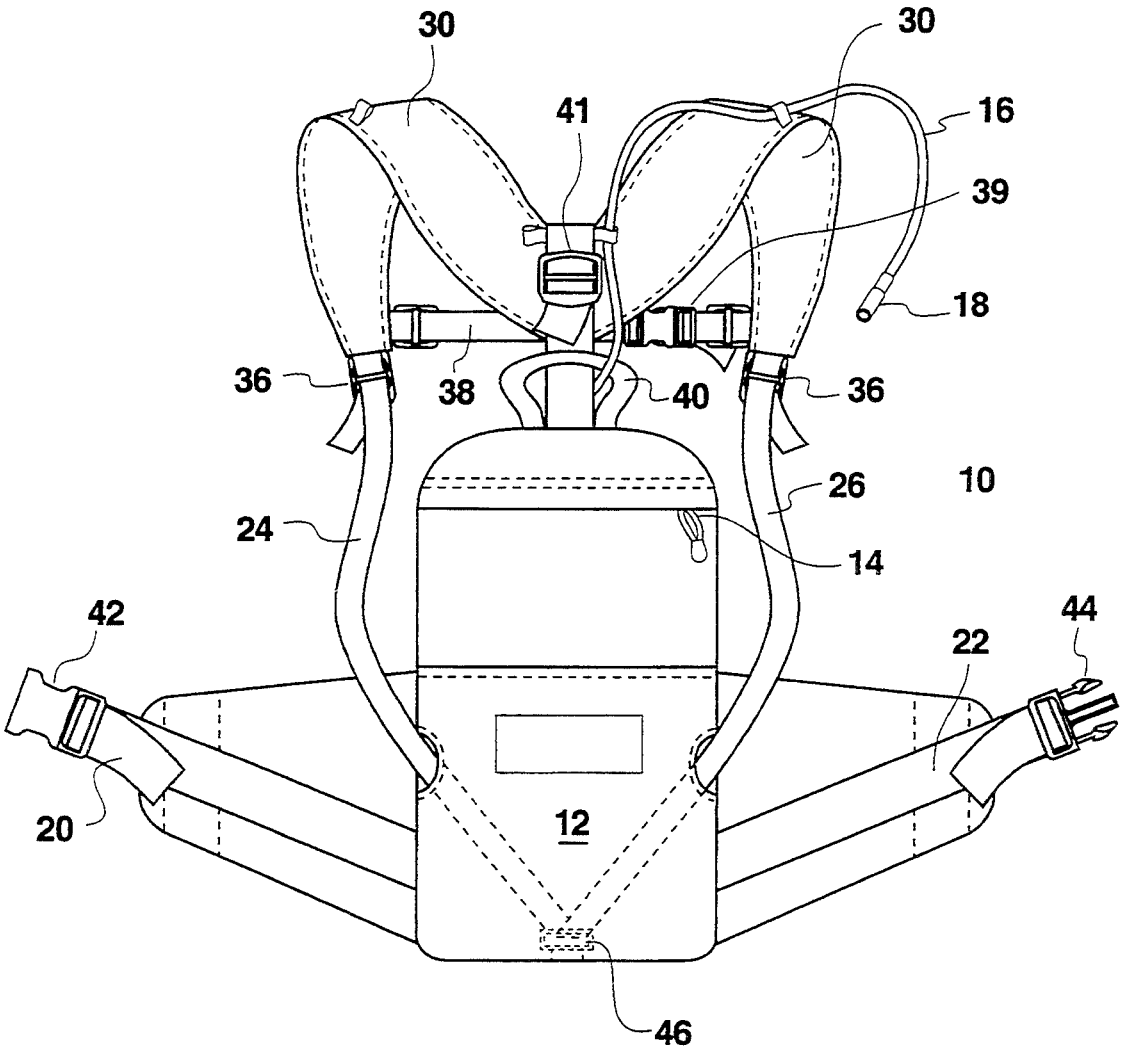
FIG. 1 is a back elevation view of the water pouch backpack.
Figure 2:
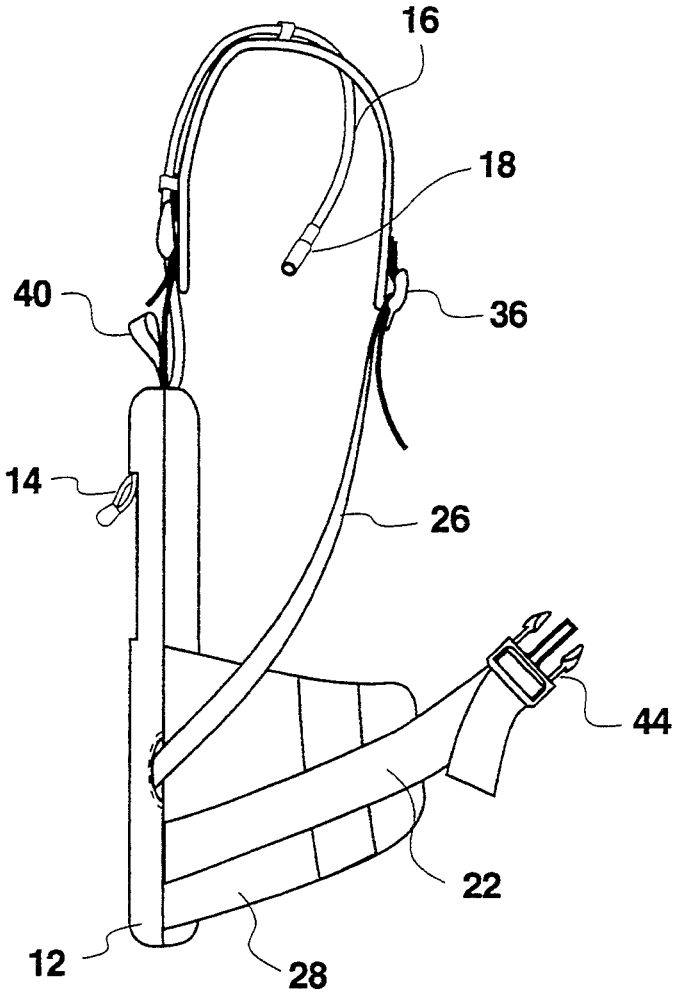
FIG. 2 is a side elevation of the pack.

Referring to FIGS. 1 and 2 the water pouch backpack can be seen at 10 as seen from the back. The body 12 of pack has a zippered access 14 and plastic tube 16 provides communication to the water bladder assembly within the body 12. Water can be obtained by opening push/pull valve 18 and sucking on the plastic valve 18.

The pack is attached to a persons back by placing nylon-mesh hip belt section 20 and 22 around the hips and sliding one's arms through shoulder strap 24 and 26. Foam padding is provided at shoulder pads 30 which are attached to adjustable shoulder straps 24 and 26. The shoulder straps 24 and 26 are adjustable in length at adjustment loops 36. A horizontal strap 38 and buckle 39 pull the two shoulder straps together below the wearer's neck on the sternum. A nylon carrying strap 40 is at a top portion of the body 12. Directly above the carrying strap is a vertically adjustable loop 41 that connects the shoulder pad 30 to the upper body to adjust for people of different heights. A convenient quick disconnectable hip belt and buckle, parts 42 and 44, are adjustable at male portion 44. A novel feature of the shoulder straps 24 and 26 is that they are continuous and slide through loop 46 within the pack allowing the pack to remain stationary as the shoulders rotate.

Figure 4:
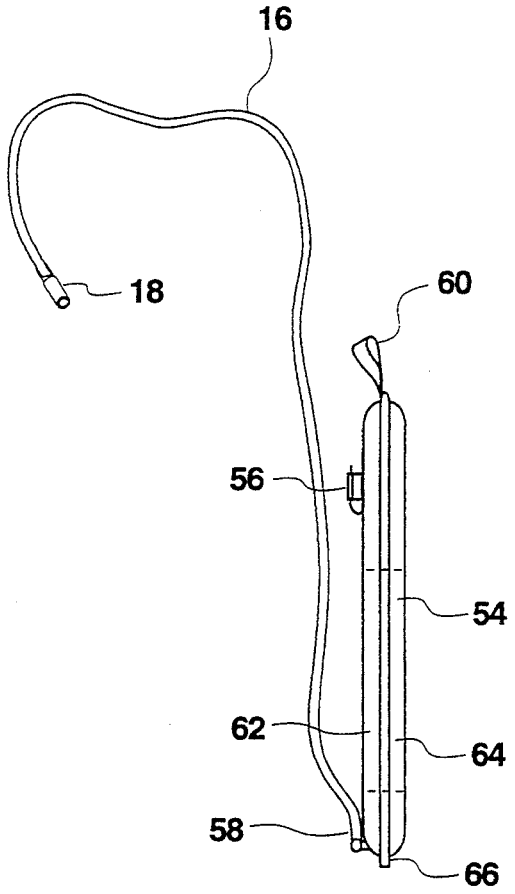
FIG. 4 is a side elevation of the bladder assembly.
Figure 3:
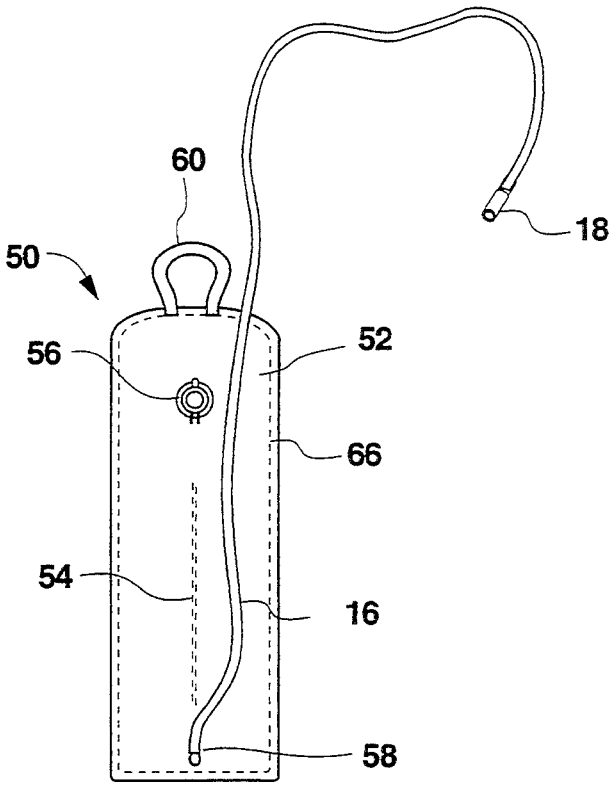
FIG. 3 is a front elevation of the bladder assembly.

Referring to FIG. 3, the bladder assembly, after removal from the pack, is seen at 50 and consists of a flexible nylon, rectangular bladder 52, having an internal baffle 54, a filling connection 56, a tube connection 58 at the bottom, and a carrying handle 60. The longitudinal nylon baffle 54 (in phantom in FIG. 4) being connected between the front 62 and back 64 inside surfaces, serves to maintain a proper flat shape and prevents sloshing in water. The assembly can be made by sealing the baffle 54 to the inside of the front 62 and back 64 section and then closing the bladder 50 by sealing the edges at seam 66. Without baffle 54 the bladder would tend to balloon out at the front 62 and back 64 and be uncomfortable to the wearer.

Since the pack is in the small of the person's back, the fluid does not flow by gravity but by drawing a vacuum on the valve 18 and tube 16.

The bladder assembly can also serve purposes other than storing liquids as listed below:

1. filled with air to provide a backrest cushion;
2. filled with air to use as a pillow;
3. filled with water and solar heated to provide a warm shower; and
4. filled with cold water and ice to cool the person's back.

While a preferred embodiment of the invention has been disclosed, various modes of carrying out the principles disclosed herein are contemplated as being within the scope of the following claims. Therefore, it is understood that the scope of the invention is not to be limited except as otherwise set forth in the claims.

What is claimed is:

1. A sportsman's water pouch backpack comprising:

(a) a body having a chamber and an access to the chamber;

(b) an adjustable hip belt and buckle attaching to a lower portion of the body;

(c) a pair of adjustable shoulder straps connecting from an upper portion of the body to a loop within a lower portion of the body, said shoulder straps slidably affixed within the loop thereby allowing the pack to remain stationary as a sportsman's shoulders rotate; and (d) a bladder assembly inserted within the body further comprising;

(i) a flexible bladder having a baffle within the bladder thereby preventing a ballooning of the bladder when filled with a fluid;

(ii) a tube having a first end in communication with an inside of the bladder and having a valve on a second end;

(iii) a filling connection and filler cap on the bladder in communication with the inside of the bladder and having a fabric handle adjacent to the filling connection.

2. The backpack as recited in claim 1 wherein the hip belt is nylon mesh and the shoulder straps have a padded middle section.

3. The backpack as recited in claim 2 wherein the valve operation is from a pull-to-open position from a closed position.

4. The backpack as recited in claim 3 wherein the shoulder straps are affixed on a person's sternum by an adjustable horizontal strap and buckle.

5. The bladder assembly as recited in claim 1 wherein the flexible bladder is of a rectangular shape and the baffle runs in a longitudinal direction.

6. A sportsman's water pouch backpack comprising:

(a) a body having a chamber and an access to the chamber;

(b) an adjustable, mesh hip belt and buckle attaching to a lower portion of the body;

(c) a pair of adjustable, padded shoulder straps connecting from an upper portion of the body to a loop within a lower portion of the body, said shoulder straps slidably affixed within the loop thereby allowing the pack to remain stationary as a sportsman's shoulders rotate; and (d) a bladder assembly inserted within the body further comprising;

(i) a flexible rectangular bladder having a longitudinal baffle within the bladder thereby preventing a ballooning of the bladder and sloshing when filled with a fluid;

(ii) a tube having a first end in communication with an inside of the bladder and having a valve on a second end;

(iii) a filling connection and filler cap on the bladder in communication with the inside of the bladder and having a fabric handle adjacent to the filling connection.

7. The backpack as recited in claim 6 wherein valve operation is from a pull-to-open position from a closed position.

8. The backpack as recited in claim 7 wherein the shoulder straps are affixed on a person's sternum by an adjustable horizontal strap and buckle.

9. A sportsman's water pouch backpack comprising;

(a) a body having a chamber and an access to the chamber;

(b) an adjustable, nylon-mesh hip belt and buckle attaching to a lower portion of the body;

(c) a pair of adjustable, padded shoulder straps connecting from an upper portion of the body to a loop within a lower portion of the body, said shoulder straps slidably affixed within the loop thereby allowing the pack to remain stationary as a sportsman's shoulders rotate; and (d) a nylon, rectangular bladder assembly inserted within the body further comprising;

(i) a flexible rectangular bladder having a longitudinal baffle within the bladder thereby preventing a ballooning of the bladder and sloshing when filled with a fluid;

(ii) a tube having a first end in communication with an inside of the bladder and having a valve on a second end;

(iii) a filling connection and filler cap on the bladder in communication with the inside of the bladder and having a fabric handle adjacent to the filling connection.

10. The backpack as recited in claim 9 wherein valve operation is from a pull-to-open position from a closed position.

11. The backpack as recited in claim 10 wherein the shoulder straps are affixed on a person's sternum by an adjustable horizontal strap and buckle.

* * * * *